US006826917B1

(12) United States Patent
Bodell, II et al.

(10) Patent No.: US 6,826,917 B1
(45) Date of Patent: Dec. 7, 2004

(54) INITIAL PULL DOWN CONTROL FOR A MULTIPLE COMPRESSOR REFRIGERATION SYSTEM

(75) Inventors: Mark Robinson Bodell, II, York, PA (US); Wanda Jean Miller, Harrisburg, PA (US)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 10/632,610

(22) Filed: Aug. 1, 2003

(51) Int. Cl.[7] ..... F25B 1/00

(52) U.S. Cl. ..... 62/115; 62/133; 62/196.2; 62/510

(58) Field of Search ..... 62/115, 157, 185, 62/196.2, 201, 204, 209, 129, 228.5, 510

(56) References Cited

U.S. PATENT DOCUMENTS

| | | | | |
|---|---|---|---|---|
| 4,152,902 A | | 5/1979 | Lush | |
| 4,171,623 A | * | 10/1979 | Lavigne et al. | 62/196.2 |
| 4,282,718 A | | 8/1981 | Kountz et al. | |
| 4,307,576 A | | 12/1981 | Takano et al. | |
| 4,393,662 A | | 7/1983 | Dirth | |
| 4,487,028 A | | 12/1984 | Foye | |
| 4,506,516 A | * | 3/1985 | Lord | 62/117 |
| 4,506,518 A | | 3/1985 | Yoshikawa et al. | |
| 4,621,502 A | | 11/1986 | Ibrahim et al. | |
| 4,633,675 A | | 1/1987 | Sato | |
| 4,646,530 A | * | 3/1987 | Huenniger | 62/175 |
| 4,679,404 A | | 7/1987 | Alsenz | |
| 4,689,967 A | | 9/1987 | Han et al. | |
| 4,753,083 A | | 6/1988 | Sato | |
| 4,825,662 A | | 5/1989 | Alsenz | |
| 4,951,475 A | | 8/1990 | Alsenz | |
| 5,027,608 A | * | 7/1991 | Rentmeester et al. | 62/115 |
| 5,083,438 A | * | 1/1992 | McMullin | 62/129 |
| 5,148,685 A | | 9/1992 | Takano et al. | |
| 5,222,370 A | * | 6/1993 | James | 62/175 |
| 5,284,026 A | | 2/1994 | Powell | |
| 5,419,146 A | | 5/1995 | Sibik et al. | |
| 5,491,982 A | * | 2/1996 | Gowens | 62/434 |
| 5,600,960 A | * | 2/1997 | Schwedler et al. | 62/99 |
| 5,632,154 A | * | 5/1997 | Sibik et al. | 62/99 |
| 6,176,092 B1 | * | 1/2001 | Butterworth et al. | 62/84 |
| 6,185,946 B1 | * | 2/2001 | Hartman | 62/175 |
| 6,276,152 B1 | * | 8/2001 | Sibik | 62/201 |
| 6,293,112 B1 | * | 9/2001 | Moeykens et al. | 62/84 |

FOREIGN PATENT DOCUMENTS

| | | | |
|---|---|---|---|
| JP | 402197779 A | * | 8/1990 |
| JP | 405126418 A | * | 5/1993 |

* cited by examiner

*Primary Examiner*—William E. Tapolcai
*Assistant Examiner*—Mohammad M. Ali
(74) *Attorney, Agent, or Firm*—McKee Wallace & Nurick LLC

(57) ABSTRACT

A control system is provided to determine when to use additional compressors in a multiple compressor refrigeration system during a pull down operation. The control system determines the rate of change of the difference between the leaving chilled water temperature and a setpoint temperature during the pull down operation of the refrigeration system. If the determined rate of change of the leaving chilled water temperature difference provided by the current configuration of the refrigeration system is not adequate, then an additional compressor of the refrigeration system can be started to obtain a better rate of change. The control system can repeat this evaluation of the determined rate of change of the leaving chilled water temperature difference until all compressors in the multiple compressor refrigeration system are used.

47 Claims, 3 Drawing Sheets

INITIAL PULL DOWN CONTROL FOR A MULTIPLE COMPRESSOR REFRIGERATION SYSTEM

BACKGROUND OF THE INVENTION

The present invention relates generally to a control system for a multiple compressor refrigeration or air conditioning system. Specifically, the present invention relates to a control system that determines when to start additional compressors in a multiple compressor refrigeration or air conditioning system during an initial pull down operation of the refrigeration or air conditioning system.

In a refrigeration system that uses a chilled liquid, the chilled liquid is circulated through a building or area to remove heat from the building and cool the building. When cooling is no longer required in the building, the refrigeration system is shut down and the previously chilled liquid that cooled the building is permitted to warm to ambient or close to ambient temperatures. When cooling is again required in the building, the temperature of the liquid to be circulated through the building has to be pulled down from an elevated temperature to the appropriate operating setpoint temperature for effective cooling of the building. This process of chilling the liquid that is circulated in a building from an elevated temperature to the operating setpoint temperature is commonly referred to as a pull down operation.

In a multiple compressor refrigeration or chiller system, it is common to cycle the compressors in order to match the chiller system capacity to the building cooling load. Some techniques used to evaluate and control chiller system capacity can include comparing the leaving chilled liquid temperature, i.e., the temperature of the liquid from the evaporator used to cool the building, to a desired operating setpoint temperature and/or comparing the compressor motor power to the maximum compressor motor power. Both of these techniques can be effective to provide adequate control of the chiller system when the chiller system is operating in a steady state mode. However, these techniques may provide a false indication of the need for additional chiller system capacity during a pull down operation. For example, during a pull down operation the difference between the leaving chilled liquid temperature and the operating setpoint temperature is often large, which large difference in temperatures would indicate the need for additional system capacity even though the currently operating compressor(s) may provide more than enough system capacity for the building cooling load. This false indication can occur when the currently operating compressors have not yet had time to pull down the leaving chilled liquid temperature to the operating setpoint temperature.

Some potential problems with having too much chiller system capacity during a pull down operation include the possibility of overshooting the operating setpoint temperature and the possibility of frequent cycling on and off of the compressor motors. An overshoot of the operating setpoint temperature occurs when the leaving chilled liquid temperature continues to decrease past the operating setpoint temperature. If the leaving chilled liquid temperature becomes too low, the liquid in the evaporator may start to freeze which can reduce system efficiency and potentially cause damage to the chiller system. The frequent cycling on and off of compressor motors is also undesirable because it results in greater energy consumption by the chiller system. Furthermore, in very large chiller systems using very large chiller motors, there may be limits placed on the starting of the compressor motors, which limitations can result in a compressor not being started even though there is a demand for additional chiller system capacity. One example of where a motor may not be able to be started can occur when an additional compressor is cycled on for the pull down operation, is cycled off once the operating setpoint temperature has been reached, and then is needed to be cycled on again for steady state operation of the chiller system to satisfy the building cooling load but cannot be cycled on because of a limitation on the number of starts of the compressor motor.

Therefore, what is needed is a control algorithm that can determine when a current compressor configuration in a multiple compressor refrigeration or chiller system is inadequate to pull down the leaving chiller liquid temperature to the desired operating setpoint temperature and can start an additional compressor in the multiple compressor refrigeration system to assist in the pull down of the leaving chiller liquid temperature to the desired operating setpoint temperature without unnecessary cycling of the additional compressor.

SUMMARY OF THE INVENTION

One embodiment of the present invention is directed to a method for determining when to start additional compressors in a multiple compressor chiller system during a pull down operation of a leaving chilled liquid temperature in the multiple compressor chiller system. The method includes the step of measuring a parameter of a multiple compressor chiller system. The measured parameter is related to a leaving chilled liquid temperature of the multiple compressor chiller system. The method also includes the steps of calculating a rate of change of the measured parameter of the multiple compressor chiller system and comparing the calculated measured parameter rate of change with a predetermined rate of change for the measured parameter. Finally, the method includes the step of starting an additional compressor in the multiple compressor chiller system in response to the calculated measured parameter rate of change being less than the predetermined rate of change for the measured parameter.

Another embodiment of the present invention is directed to a method for controlling a pull down operation of a secondary liquid leaving an evaporator in a multiple compressor refrigeration system from an elevated temperature to a setpoint temperature. The method includes operating a predetermined number of compressors in a multiple compressor refrigeration system in response to a temperature of a secondary liquid leaving an evaporator in the multiple compressor system being elevated. The operation of the predetermined number of compressors pulls down the temperature of the secondary liquid leaving the evaporator toward a setpoint temperature. Next, a parameter of the multiple compressor system related to the to the temperature of the secondary liquid leaving the evaporator is measured and a rate of change of the measured parameter is determined. The determined measured parameter rate of change is compared with a predetermined rate of change for the measured parameter and an additional compressor in the multiple compressor refrigeration system is operated in response to the determined measured parameter rate of change being less than the predetermined rate of change for the measured parameter. The operation of the additional compressor assists the predetermined number of compressors in pulling down the temperature of the secondary liquid leaving the evaporator toward the setpoint temperature.

Still a further embodiment of the present invention is directed to a computer program product embodied on a computer readable medium and executable by a microprocessor for determining when to start additional compressors in a multiple compressor chiller system during a pull down operation of a leaving chilled liquid temperature in the multiple compressor chiller system. The computer program product includes computer instructions for executing the step of measuring a parameter of a multiple compressor chiller system. The measured parameter is related to a leaving chilled liquid temperature of the multiple compressor chiller system. The computer program product also includes steps for executing the steps of determining a rate of change of the measured parameter of the multiple compressor chiller system and comparing the determined measured parameter rate of change with a predetermined rate of change for the measured parameter. Finally, the computer program product includes computer instructions for starting an additional compressor in the multiple compressor chiller system in response to the determined measured parameter rate of change being less than the predetermined rate of change for the measured parameter.

One advantage of the present invention is that it extends the refrigeration or chiller system's service life by limiting the number of starts of the compressor motors of the refrigeration system.

Another advantage of the present invention is that it can provide energy savings and avoid overshoot of a setpoint temperature by conducting the pull down operation at an appropriate rate.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
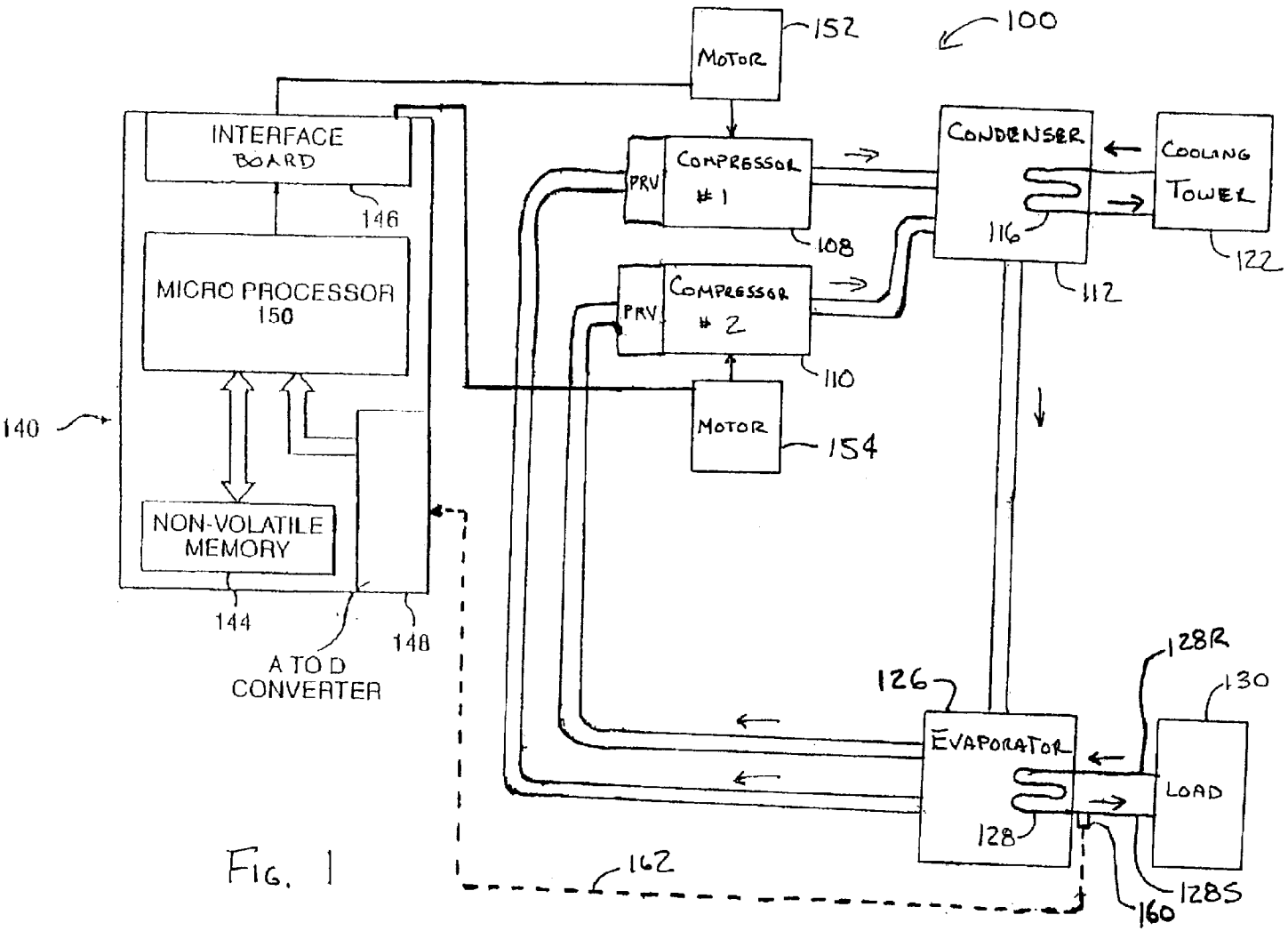
FIG. 1 illustrates schematically a refrigeration system of the present invention.

A general multiple compressor refrigeration system to which the invention can be applied is illustrated, by means of example, in FIG. 1. As shown, the HVAC, refrigeration or liquid chiller system 100 has two compressors, but it is to be understood that the system 100 can have more than two compressors for providing the desired system load. The system 100 includes a first compressor 108, a second compressor 110, a condenser 112, a water chiller or evaporator 126, and a control panel 140. The control panel 140 can include an analog to digital (A/D) converter 148, a microprocessor 150, a non-volatile memory 144, and an interface board 146. The operation of the control panel 140 will be discussed in greater detail below. The conventional HVAC, refrigeration or liquid chiller system 100 includes many other features that are not shown in FIG. 1. These features have been purposely omitted to simplify the drawing for ease of illustration.

The compressors 108 and 110 compress a refrigerant vapor and deliver it to the condenser 112. The compressors 108 and 110 are preferably connected in a common refrigeration circuit, i.e., the refrigerant output by the compressors 108 and 110 is combined into a single circuit to travel through the system 100 before being separated again for re-input into the compressors 108 and 110 to begin another cycle. The combination of the refrigerant output of the compressors 108 and 110 preferably occurs in the condenser 112, but can occur upstream of the condenser 112. Similarly, the separation of the refrigerant input to the compressors 108 and 110 preferably occurs in the evaporator 126, but can occur downstream of the evaporator 126. In another embodiment of the present invention, the compressors 108 and 110 are connected in parallel refrigeration circuits that share a common evaporator 126 and condenser 112 for heat exchanging purposes, i.e., the refrigerant output by each compressor 108 and 110 travels through the system 100 in a separate circuit and is not combined with the refrigerant output of the other compressor.

The compressors 108 and 110 are preferably centrifugal compressors, however the compressors can be any suitable type of compressor including screw compressors, reciprocating compressors, scroll compressors, rotary compressors or other type of compressor. The refrigerant vapor delivered to the condenser 112 enters into a heat exchange relationship with a fluid, preferably water, flowing through a heat-exchanger coil 116 connected to a cooling tower 122. The refrigerant vapor in the condenser 112 undergoes a phase change to a refrigerant liquid as a result of the heat exchange relationship with the fluid in the heat-exchanger coil 116. The condensed liquid refrigerant from condenser 112 flows to an evaporator 126.

The evaporator 126 can include a heat-exchanger coil 128 having a supply line 128S and a return line 128R connected to a cooling load 130. The heat-exchanger coil 128 can include a plurality of tube bundles within the evaporator 126. A secondary liquid, which is preferably water, but can be any other suitable secondary liquid, e.g. ethylene, calcium chloride brine or sodium chloride brine, travels into the evaporator 126 via return line 128R and exits the evaporator 126 via supply line 128S. The liquid refrigerant in the evaporator 126 enters into a heat exchange relationship with the liquid in the heat-exchanger coil 128 to chill the temperature of the liquid in the heat-exchanger coil 128. The refrigerant liquid in the evaporator 126 undergoes a phase change to a refrigerant vapor as a result of the heat exchange relationship with the liquid in the heat-exchanger coil 128. The vapor refrigerant in the evaporator 126 then returns to the compressors 108 and 110 to complete the cycle. While the above fluid flow configurations of the refrigerant and other fluids in the condenser 112 and evaporator 126 are preferred, it is to be understood that any suitable fluid flow configuration for the condenser 112 and evaporator 126 can be used for the exchange of heat with the refrigerant.

To drive the compressors 108 and 110, the system 100 includes a motor or drive mechanism 152 for the first compressor 108 and a motor or drive mechanism 154 for the second compressor 110. While the term "motor" is used with respect to the drive mechanism for the compressors 108 and 110, it is to be understood that the term "motor" is not limited to a motor but is intended to encompass any component that can be used in conjunction with the driving of the compressors 108 and 110, such as a variable speed drive and a motor starter. In a preferred embodiment of the present invention the motors or drive mechanisms 152 or 154 are electric motors and associated components. However, other drive mechanisms such as steam or gas turbines or engines and associated components can be used to drive the compressors 108 and 110.

In a preferred embodiment of the present invention wherein compressors 108 and 110 are centrifugal compressors, there are preferably one or more pre-rotation vanes or inlet guide vanes that control the flow of refrigerant to the compressors 108 and 110 and are positioned at the input or inlets to the compressors 108 and 110 from the evaporator 126. Actuators are used to open the pre-rotation vanes to increase the amount of refrigerant to the compressors 108 and 110 and thereby increase the cooling capacity of the system 100. Similarly, the actuators are used to close the pre-rotation vanes to decrease the amount of refrigerant to the compressors 108 and 110 and thereby decrease the cooling capacity of the system 100.

The system 100 also includes a sensor 160 for sensing the temperature of the leaving chilled liquid from the evaporator 126. The sensor 160 is preferably in the chilled secondary liquid flow, at the outlet pipe or supply line 128S from the evaporator 126. However, the sensor 160 can be placed in any location that provides an accurate measurement of the leaving chilled liquid temperature (LCHLT). A signal, either analog or digital, corresponding to the LCHLT is then transferred over a line 162 from the sensor 160 to the control panel 140. In another embodiment of the present invention, the sensor 160 can measure the temperature or pressure of the refrigerant within the evaporator 126, which refrigerant temperature or pressure is related to the LCHLT.

In one embodiment of the present invention, the sensor 160 for measuring the LCHLT is preferably a temperature thermistor, however, other types of temperature sensors may also be employed. The thermistor provides a resistance that is proportional to the temperature. The resistance from the thermistor is then converted to a voltage signal, using a resistor divider connected to a voltage source or any other suitable technique for generating a voltage. The voltage signal is then transferred over line 162 to the control panel 140.

If necessary, the signal input to control panel 140 over line 162 is converted to a digital signal or word by A/D converter 148. The digital signal (either from the A/D converter 148 or from the sensor 160) is then input into the control algorithm, which is described in more detail in the following paragraphs, to generate a control signal for starting a motor of one of the compressors. In another embodiment of the present invention, if the sensor 160 is not measuring the LCHLT, then the appropriate parameter measured by the sensor 160 such as evaporator temperature or pressure is input into the control algorithm. The control signal for starting one of the compressors is provided to the interface board 146 of the control panel 140 by the microprocessor 150, as appropriate, after executing the control algorithm. The interface board 146 then provides the control signal to the motor and compressor to be started in the chiller system 100.

Microprocessor 150 uses a control algorithm to determine when to start an additional compressor and motor in the system 100 during a pull down operation. In one embodiment, the control algorithm can be a computer program having a series of instructions executable by the microprocessor 150. The control algorithm determines during a pull down of the LCHLT, whether to start an additional compressor of the system 100 or whether to keep the system 100 in its current operating state. While it is preferred that the control algorithm be embodied in a computer program(s) and executed by the microprocessor 150, it is to be understood that the control algorithm may be implemented and executed using digital and/or analog hardware by those skilled in the art. If hardware is used to execute the control algorithm, the corresponding configuration of the control panel 140 can be changed to incorporate the necessary components and to remove any components that may no longer be required, e.g. the A/D converter 148.

In addition to using the control algorithm to determine whether to start an additional compressor of the system 100 during a pull down of the LCHLT, the microprocessor 150 also executes additional control algorithms to control the "steady state" or normal operation of the system 100, i.e., the LCHLT is maintained in a temperature band about a predetermined setpoint temperature to satisfy load demands. During both the pull down operation and the normal operation of the system 100, one of the compressors is designated as the "lead" compressor and the other compressor is designated as the "lag" compressor. The designation of a compressor 108 and 110 as the lead compressor or the lag compressor can be dependent on several factors or goals such as equalizing compressor run time, or the capacity of the compressors. In addition, the designation of the lead compressor and the lag compressor can be changed periodically with no affect on the operation of the control algorithm. In the following description, the first compressor 108 will be designated as the lead compressor and the second compressor 110 will be designated as the lag compressor.

Figure 2:
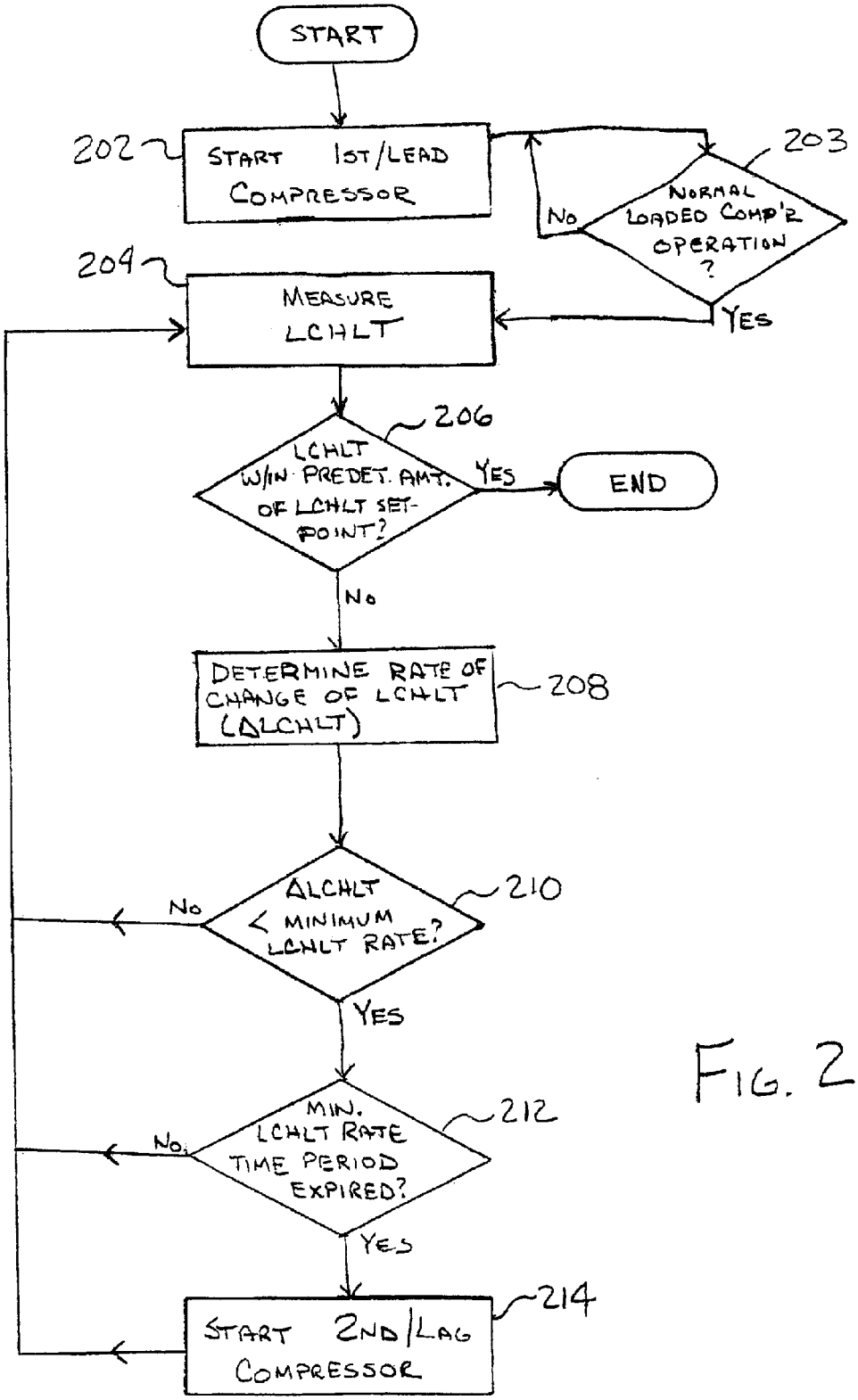
FIG. 2 illustrates a flow chart of the pull down control algorithm of the present invention.

FIG. 2 illustrates the pull down control algorithm of the present invention for determining when to bring on or start additional compressors in a multiple compressor refrigeration system during a pull down operation. The process for determining when to bring on or start additional compressors in a multiple compressor refrigeration system during a pull down operation will be described in the context of the refrigeration system 100 illustrated in FIG. 1, however, it is to be understood that the process could be applied to any multiple compressor system, including a system with more than two compressors. In response to the activation or starting of the system 100 from an idle or off state, the process begins by activating or starting the first or lead compressor 108 at step 202.

After the first compressor 108 has been started in step 202, the compressor 108 is evaluated in step 203 to determine if the compressor 108 is in a normal loaded, regular or steady state operating condition, i.e., the compressor 108 is no longer operating in a starting or warm-up mode of operation. It is to be understood that the steady state or normal loaded operating condition for the compressor 108 is different from the steady state operation of the system 100 discussed above. In a preferred embodiment of the present invention, the compressor 108 is considered to be in a normal loaded operating state or condition upon the expiration of a predetermined "warm-up" time period. The predetermined warm-up time period for the compressor 108 can range from 1–5 minutes and is preferably 3 minutes, but can be any suitable time period necessary for the compressor 108 to reach a normal loaded operating state. If the compressor 108 has not reached a normal loaded operating state in step 203, the process returns to before step 203 (possibly with a time delay) and the compressor 108 is again evaluated in step 203 to determine if the compressor 108 has reached a normal loaded operating state. Once the compressor 108 has reached a normal loaded operating state, the leaving chilled liquid temperature (LCHLT) is then measured in step 204. While the measurement of the LCHLT is preferred in step 204, it is to be understood that other parameters can be measured instead of the LCHLT, e.g. the temperature or pressure of the refrigerant in the evaporator 126, or other similar parameter.

In another embodiment of the present invention, the compressor 108 can be determined to be in a normal loaded operating state in step 203 by measuring an operating parameter of the compressor 108 instead of waiting for the expiration of the predetermined time period. For example, the amount of motor current used by the compressor motor or the positioning of any pre-rotation vanes of the compressor 108 can be measured and used to determine that the compressor 108 has reached a normal loaded operating state. The compressor can be considered to be operating in a normal loaded operating state when the measured motor current is equal to or greater than a predetermined current level, e.g. 100% of the full load current or the allowable motor current, or when the measured position of the pre-rotation vanes is equal to or more open than a predetermined position, e.g., a fully open position.

In still another embodiment of the present invention, step 203 can occur after the measurement of the LCHLT in step 204 shown in FIG. 2. In this embodiment, if the compressor 108 is determined to be operating in a normal loaded operating state, the process would then continue or resume at the point immediately after where step 203 was conducted. However, if the compressor 108 is not operating in a normal loaded operating state, the process would return to step 204 for another measurement of the LCHLT and the process steps would be repeated until the compressor 108 is determined to be operating in a normal loaded operating state in step 203.

Referring back to FIG. 2, the measured LCHLT from step 204 is compared to an LCHLT setpoint temperature in step 206. The LCHLT setpoint temperature is the temperature of the leaving chilled liquid that is used for steady state operation of the system 100 and can be determined based on a variety of factors including the type of secondary liquid used by the system 100 and the size of the load 130 to be cooled. If the measured LCHLT is within a predetermined offset amount of the LCHLT setpoint temperature in step 206, then the pull down process ends and a steady state operation of the system is started. The predetermined offset amount can be between 1–5 degrees and is preferably 2 degrees. In other words, the LCHLT has to be within 1–5 degrees and preferably 2 degrees of the LCHLT setpoint temperature for the pull down process to end, i.e., the temperature difference between the measured LCHLT and the LCHLT setpoint temperature is less than between 1–5 degrees and is preferably less than 2 degrees. If the measured LCHLT is not within the predetermined offset amount of the LCHLT setpoint temperature, the pull down process continues at step 208.

In another embodiment of the present invention, if the refrigerant temperature or pressure in the evaporator 128 is being measured instead of the LCHLT, then the setpoint for the refrigerant temperature or pressure would be based on the refrigerant temperature or pressure that occurs during steady state operation of the system 100. In addition, the predetermined offset amount for this embodiment would be a corresponding value of refrigerant temperature or pressure that corresponds to the predetermined offset amount for the LCHLT.

In step 208, the rate of change of the LCHLT (ΔLCHLT) is determined.

To determine the ΔLCHLT, the LCHLT has to be sampled at predetermined sampling intervals. This sampling process preferably involves the repeating of step 204 and possibly step 206 at the predetermined sampling interval. The predetermined sampling interval can range from a few seconds to a few minutes depending a variety of factors including the size of the system 100 and the desired amount of control precision. In a preferred embodiment of the present invention, the predetermined sampling interval is 1 minute. The ΔLCHLT is preferably determined by subtracting the current LCHLT measurement from the prior LCHLT measurement and then dividing by the predetermined sampling interval. For example, if the current LCHLT measurement is 55 degrees, the prior LCHLT measurement is 56 degrees, and the predetermined sampling period is 1 minute, then the ΔLCHLT would be (56 degrees−55 degrees)/1 minute or 1 degree per minute. In some embodiments it may be necessary to wait for a predetermined time period ranging from one sampling period to several sampling periods to expire before a ΔLCHLT can be determined for use in the pull down process. This waiting time period may be necessary if the system 100 has not yet entered a consistent mode of operation.

In another embodiment of the present invention, instead of using the ΔLCHLT, the rate of change of the temperature difference between the LCHLT and LCHLT setpoint temperature (ΔTD) can be used. The LCHLT would still be sampled at the predetermined sampling interval, but then the LCHLT would be compared to the LCHLT setpoint temperature (similar to the comparison in step 206) to obtain the temperature difference between the LCHLT and LCHLT setpoint temperature. The (ΔTD) can then be determined by subtracting the current temperature difference from the prior temperature difference and dividing by the predetermined sampling interval.

The ΔLCHLT (or the ΔTD) is then compared with a predetermined minimum rate of change value in step 210. The predetermined minimum rate of change value can range between 0.5–2 degrees per minute and is preferably 1 degree per minute. It is to be understood that a different time interval results in a different amount for the temperature value. Furthermore, the predetermined rate of change can vary based on the system size and the desired system performance. In another embodiment of the present invention, if the temperature or pressure of the refrigerant in the evaporator 128 is being used instead of the LCHLT, then the predetermined minimum rate of change value would be a corresponding rate of change value of refrigerant temperature or pressure that corresponds to the predetermined rate of change value for the LCHLT.

If the ΔLCHLT is greater than the predetermined minimum rate of change value, then the process returns to step 204 and awaits the expiration of the predetermined time interval, if necessary, because the first compressor is able to adequately pull down the LCHLT. If the ΔLCHLT is less than the predetermined minimum rate of change value, then the process continues to step 212. In step 212, it is determined if a predetermined minimum ΔLCHLT time period has expired. The predetermined minimum ΔLCHLT time period can range from 1–20 minutes and is preferably 5 minutes. In step 212, it is determined if the ΔLCHLT has been less than the predetermined rate of change for the predetermined minimum ΔLCHLT time period. If the ΔLCHLT has been less than the predetermined rate of change for the predetermined minimum ΔLCHLT time period, then the second or lag compressor is started in step 214 to provide additional capacity for pulling down the LCHLT and the process returns to step 204. Otherwise, the process returns to step 204 and awaits the expiration of the predetermined time interval, if necessary, to determine if the first compressor can adequately pull down the LCHLT before the predetermined minimum ΔLCHLT time period has expired.

In another embodiment of the present invention, the amount of motor current used by the compressor motor can be measured and used in the pull down control process of the present invention in conjunction with the ΔLCHLT evaluation of steps 208–212. In this embodiment, steps 208–212 would be completed as described above, but the second or lag compressor would not be started in step 214 until a determination is made that a predetermined setpoint current level for the compressor motor is larger than a predetermined amount, e.g. 50% of full load current. During normal loaded operation of the compressor 108, the amount of current provided to the compressor motor is limited to a predetermined setpoint current level for appropriate operation of the compressor 108. The predetermined setpoint current level can be any value in the range of 30% to 100% of the full load current and is preferably 100% of the full load current.

While the above process has been described with respect to two compressors, it can be applied to refrigeration or chiller system utilizing more than two compressors. When more than two compressors are used, the process step 214 described above would be modified to start the next compressor in the compressor starting sequence. Thus, when the process returns to step 204, the process may be repeated until all of the compressors in the refrigeration or chiller system have been started.

Figure 3:
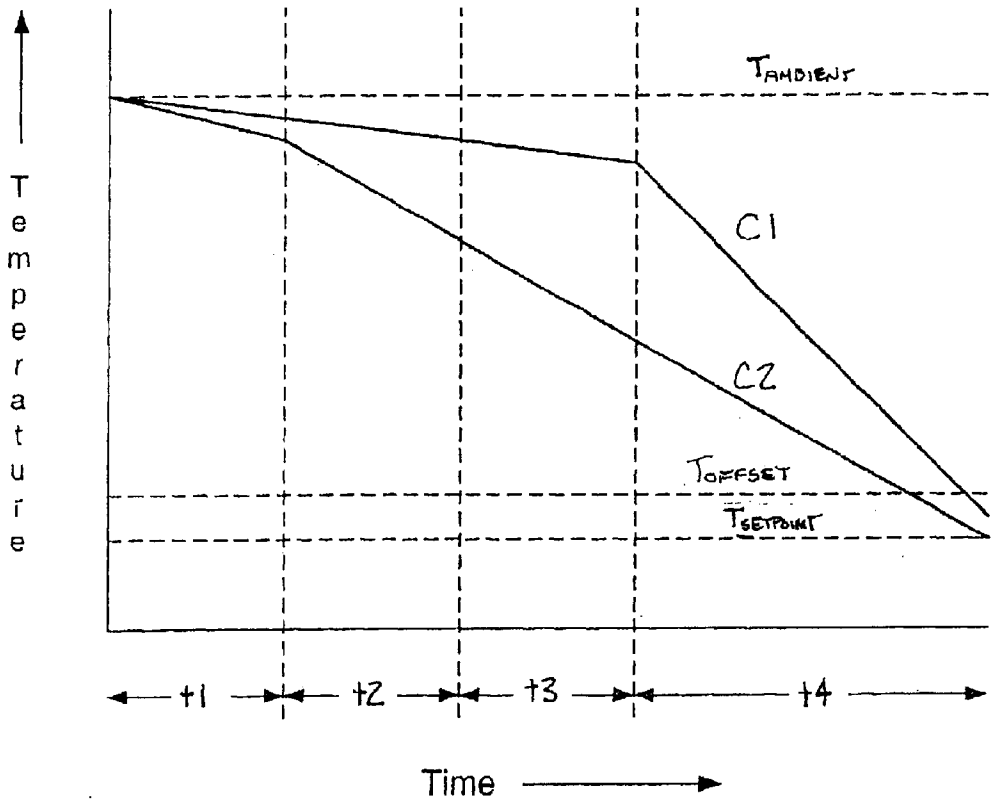
FIG. 3 illustrates a graph of the leaving chilled liquid temperature versus time in two examples.

To further illustrate the operation of the present invention, the graph in FIG. 3 illustrates two possible pull down scenarios. The line C1 illustrates a multiple compressor refrigeration system scenario wherein a single compressor is not adequate to pull down the LCHLT to the desired temperature ($T_{SETPOINT}$) and the line C2 illustrates a multiple compressor refrigeration system scenario wherein a single compressor is adequate to pull down the LCHLT to the desired temperature ($T_{SETPOINT}$). As can be seen in FIG. 3, both the C1 and C2 systems start at time 0 with the LCHLT being an ambient temperature ($T_{AMBIENT}$). Next, during the first time period (t1) the C1 and C2 systems are operating in the warm-up time period as described above with respect to steps 202 and 203. At the start of the second time period (t2) the ΔLCHLT for the C1 and C2 systems is calculated as described above with respect to steps 204–208. The slopes of lines C1 and C2 during t2 correspond to the ΔLCHLT for the C1 and C2 systems. The duration of t2 can correspond to either one predetermined sampling interval or to the predetermined time period necessary to obtain a consistent ΔLCHLT for the C1 and C2 systems.

At the expiration of t2, the ΔLCHLT for the C1 and C2 systems is compared to the predetermined rate of change as described above with respect to step 210. In the C1 system, the ΔLCHLT is less than the predetermined rate of change and in the C2 system the ΔLCHLT is greater than the predetermined rate of change. Thus, for the C2 system, the C2 system is operated with only a single compressor for the third time period (t3) and the fourth time period (t4) until the LCHLT is less than the predetermined offset amount of the LCHLT setpoint temperature ($T_{OFFSET}$) at the end of t4. It being understood that the ΔLCHLT is continually being checked according to the process described above with respect to FIG. 2. However, for the C1 system, the ΔLCHLT is monitored during t3 as described above with respect to step 212. The duration of t3 preferably corresponds to the minimum LCHLT rate time period.

At the expiration of t3, the ΔLCHLT for the C1 system is again compared to the predetermined rate of change as described above with respect to step 210. The ΔLCHLT is still less than the predetermined rate of change in the C1 system. Thus, a second compressor is started in the C1 system as described above with respect to step 214. The C1 system is then operated with two compressors for t4 until the LCHLT is less than the predetermined offset amount of the LCHLT setpoint temperature ($T_{OFFSET}$) at the end of t4.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for determining when to start additional compressors in a multiple compressor chiller system during a pull down operation of a leaving chilled liquid temperature in the multiple compressor chiller system, the method comprising the steps of:

measuring a parameter of a multiple compressor chiller system, wherein the measured parameter is related to a leaving chilled liquid temperature of the multiple compressor chiller system;

calculating a rate of change of the measured parameter of the multiple compressor chiller system;

comparing the calculated measured parameter rate of change with a predetermined rate of change for the measured parameter; and starting an additional compressor in the multiple compressor chiller system in response to the calculated measured parameter rate of change being less than the predetermined rate of change for the measured parameter.

2. The method of claim 1 further comprising the step of repeating the steps of measuring a parameter, calculating a rate of change of the measured parameter, comparing the calculated measured parameter rate of change and starting an additional compressor until the leaving chilled liquid temperature is within a predetermined offset amount of a setpoint operating temperature for the multiple compressor chiller system.

3. The method of claim 2 wherein the predetermined offset amount is between about 1 degree and about 5 degrees.

4. The method of claim 3 wherein the predetermined offset amount is about 2 degrees.

5. The method of claim 1 further comprising before the step of starting an additional compressor in the multiple compressor chiller system, the steps of:

measuring a time period that the calculated measured parameter rate of change is less than the predetermined rate of change for the measured parameter in response to the calculated measured parameter rate of change being less than the predetermined rate of change for the measured parameter;

comparing the measured time period to a predetermined time period; and repeating the steps of measuring a parameter, calculating a rate of change of the measured parameter, comparing the calculated measured parameter rate of change, measuring a time period, and comparing the measured time period to a predetermined time period in response to the measured time period being less than the predetermined time period.

6. The method of claim 1 wherein the step of measuring a parameter of the multiple compressor chiller system includes the step of measuring the leaving chilled liquid temperature.

7. The method of claim 6 wherein the step of calculating a rate of change of the measured parameter includes the step of calculating a rate of change of the leaving chilled liquid temperature.

8. The method of claim 7 wherein the predetermined rate of change for the measured parameter is between about 0.5 degrees per minute and about 2 degrees per minute.

9. The method of claim 8 wherein the predetermined rate of change for the measured parameter is about 1 degree per minute.

10. The method of claim 1 wherein the measured parameter of the multiple compressor chiller system comprises one of an evaporator refrigerant temperature and an evaporator refrigerant pressure.

11. The method of claim 6 wherein the step of measuring a parameter of the multiple compressor chiller system further includes the step of calculating a difference between the measured leaving chilled liquid temperature and a setpoint operating temperature for the multiple compressor chiller system.

12. The method of claim 11 wherein the step of calculating a rate of change of the measured parameter includes the step of calculating a rate of change of the difference between the measured leaving chilled liquid temperature and the setpoint operating temperature.

13. The method of claim 1 further comprising before the step of measuring a parameter of a multiple compressor chiller system, the steps of:

starting at least one compressor of the multiple compressor chiller system; and determining that the at least one compressor is in a normal loaded operating state.

14. The method of claim 13 wherein the step of determining that the at least one compressor is in a normal loaded operating state includes the steps of:

measuring an elapsed time period from the start of the at least one compressor; and comparing the elapsed time period to a predetermined time period, wherein the elapsed time period being greater than the predetermined time period is indicative that the at least one compressor is in a normal loaded operating state.

15. The method of claim 13 wherein the step of determining that the at least one compressor is in a normal loaded operating state includes the steps of:

measuring a pre-rotation vane position for the at least one compressor; and comparing the measured pre-rotation vane position to a predetermined pre-rotation vane position, wherein the measured pre-rotation vane position being substantially equal to or more open than the predetermined pre-rotation vane position is indicative that the at least one compressor is in a normal loaded operating state.

16. The method of claim 13 wherein the step of determining that the at least one compressor is in a normal loaded operating state includes the steps of:

measuring a motor current for the at least one compressor; and comparing the measured motor current to a predetermined threshold motor current, wherein the measured motor current being substantially equal to or greater than the predetermined threshold motor current is indicative that the at least one compressor is in a normal loaded operating state.

17. A computer program product embodied on a computer readable medium and executable by a microprocessor for determining when to start additional compressors in a multiple compressor chiller system during a pull down operation of a leaving chilled liquid temperature in the multiple compressor chiller system, the computer program product comprising computer instructions for executing the steps of:

measuring a parameter of a multiple compressor chiller system, wherein the measured parameter is related to a leaving chilled liquid temperature of the multiple compressor chiller system;

determining a rate of change of the measured parameter of the multiple compressor chiller system;

comparing the determined measured parameter rate of change with a predetermined rate of change for the measured parameter; and starting an additional compressor in the multiple compressor chiller system in response to the determined measured parameter rate of change being less than the predetermined rate of change for the measured parameter.

18. The computer program product of claim 17 further comprising computer instructions for executing the step of repeating the steps of measuring a parameter, determining a rate of change of the measured parameter, comparing the determined measured parameter rate of change and starting an additional compressor until the leaving chilled liquid temperature is within a predetermined offset amount of a setpoint operating temperature for the multiple compressor chiller system.

19. The computer program product of claim 18 wherein the predetermined offset amount is between about 1 degree and about 5 degrees.

20. The computer program product of claim 19 wherein the predetermined offset amount is about 2 degrees.

21. The computer program product of claim 17 further comprising computer instructions for executing before the step of starting an additional compressor in the multiple compressor chiller system, the steps of:

measuring a time period that the determined measured parameter rate of change is less than the predetermined rate of change for the measured parameter in response to the determined measured parameter rate of change being less than the predetermined rate of change for the measured parameter;

comparing the measured time period to a predetermined time period; and repeating the steps of measuring a parameter, determining a rate of change of the measured parameter, comparing the determined measured parameter rate of change, measuring a time period, and comparing the measured time period to a predetermined time period in response to the measured time period being less than the predetermined time period.

22. The computer program product of claim 17 wherein the step of measuring a parameter of the multiple compressor chiller system includes the step of measuring the leaving chilled liquid temperature.

23. The computer program product of claim 22 wherein the step of determining a rate of change of the measured parameter includes the step of determining a rate of change of the leaving chilled liquid temperature.

24. The computer program product of claim 23 wherein the predetermined rate of change for the measured parameter is between about 0.5 degrees per minute and about 2 degrees per minute.

25. The computer program product of claim 24 wherein the predetermined rate of change for the measured parameter is about 1 degree per minute.

26. The computer program product of claim 22 wherein the step of measuring a parameter of the multiple compressor chiller system further includes the step of calculating a difference between the measured leaving chilled liquid temperature and a setpoint operating temperature for the multiple compressor chiller system.

27. The computer program product of claim 26 wherein the step of determining a rate of change of the measured parameter includes the step of determining a rate of change of the difference between the measured leaving chilled liquid temperature and the setpoint operating temperature.

28. The computer program product of claim 17 wherein the measured parameter of the multiple compressor chiller system comprises one of an evaporator refrigerant temperature and an evaporator refrigerant pressure.

29. The computer program product of claim 17 further comprising computer instructions for executing before the step of measuring a parameter of a multiple compressor chiller system, the steps of:

starting at least one compressor of the multiple compressor chiller system; and determining that the at least one compressor is in a normal loaded operating state.

30. The computer program product of claim 29 wherein the step of determining that the at least one compressor is in a normal loaded operating state includes the steps of:

measuring an elapsed time period from the start of the at least one compressor; and comparing the elapsed time period to a predetermined time period, wherein the elapsed time period being greater than the predetermined time period is indicative that the at least one compressor is in a normal loaded operating state.

31. The computer program product of claim 29 wherein the step of determining that the at least one compressor is in a normal loaded operating state includes the steps of:

measuring a pre-rotation vane position for the at least one compressor; and comparing the measured pre-rotation vane position to a predetermined pre-rotation vane position, wherein the measured pre-rotation vane position being substantially equal to or more open than the predetermined pre-rotation vane position is indicative that the at least one compressor is in a normal loaded operating state.

32. The computer program product of claim 29 wherein the step of determining that the at least one compressor is in a normal loaded operating state includes the steps of:

measuring a motor current for the at least one compressor; and comparing the measured motor current to a predetermined threshold motor current, wherein the measured motor current being substantially equal to or greater than the predetermined threshold motor current is indicative that the at least one compressor is in a normal loaded operating state.

33. A method for controlling a pull down operation of a secondary liquid leaving an evaporator in a multiple compressor refrigeration system from an elevated temperature to a setpoint temperature, the method comprising the steps of:

operating a predetermined number of compressors in a multiple compressor refrigeration system in response to a temperature of a secondary liquid leaving an evaporator in the multiple compressor system being above a setpoint temperature, wherein the operation of the predetermined number of compressors pulls down the temperature of the secondary liquid leaving the evaporator toward the setpoint temperature;

measuring a parameter of the multiple compressor refrigeration system, wherein the measured parameter is related to the temperature of the secondary liquid leaving the evaporator;

determining a rate of change of the measured parameter of the multiple compressor refrigeration system;

comparing the determined measured parameter rate of change with a predetermined rate of change for the measured parameter; and operating an additional compressor in the multiple compressor refrigeration system in response to the determined measured parameter rate of change being less than the predetermined rate of change for the measured parameter, wherein the operation of the additional compressor assists the predetermined number of compressors in pulling down the temperature of the secondary liquid leaving the evaporator toward the setpoint temperature.

34. The method of claim 33 further comprising the step of repeating the steps of operating a predetermined number of compressors, measuring a parameter, determining a rate of change of the measured parameter, comparing the determined measured parameter rate of change and operating an additional compressor until the temperature of the secondary liquid leaving the evaporator is within a predetermined offset amount of the setpoint temperature.

35. The method of claim 34 wherein the predetermined offset amount is between about 1 degree and about 5 degrees.

36. The method of claim 35 wherein the predetermined offset amount is about 2 degrees.

37. The method of claim 33 further comprising before the step of operating an additional compressor in a multiple compressor refrigeration system, the steps of:

determining an operating state for the predetermined number of compressors; and repeating the step of determining an operating state for the predetermined number of compressors until the predetermined number of compressors are determined to be in a normal loaded operating state.

38. The method of claim 37 wherein the step of determining an operating state for the predetermined number of compressors includes the steps of:

measuring an elapsed time period from the step of operating of the predetermined number of compressors; and comparing the elapsed time period to a predetermined time period, wherein the elapsed time period being greater than the predetermined time period being indicative of the predetermined number of compressors being in a normal loaded operating state.

39. The method of claim 37 wherein the step of determining an operating state for the predetermined number of compressors includes the steps of:

measuring a pre-rotation vane position for the predetermined number of compressors; and comparing the measured pre-rotation vane position to a predetermined pre-rotation vane position, wherein the measured pre-rotation vane position being substantially equal to or more open than the predetermined pre-rotation vane position being indicative of the predetermined number of compressors being in a normal loaded operating state.

40. The method of claim 37 wherein the step of determining an operating state for the predetermined number of compressors includes the steps of:

measuring a motor current for the predetermined number of compressors; and comparing the measured motor current to a predetermined threshold motor current, wherein the measured motor current being substantially equal to or greater than the predetermined threshold motor current being indicative of the predetermined number of compressors being in a normal loaded operating state.

41. The method of claim 33 further comprising before the step of operating an additional compressor in a multiple compressor refrigeration system, the steps of:

measuring an elapsed time period from the step of comparing the determined measured parameter rate of change with a predetermined rate of change for the measured parameter in response to the determined measured parameter rate of change being less than the predetermined rate of change for the measured parameter;

comparing the measured elapsed time period to a predetermined time period; and repeating the steps of measuring a parameter, determining a rate of change of the measured parameter, comparing the determined measured parameter rate of change, measuring an elapsed time period, and comparing the measured elapsed time period to a predetermined time period in response to the measured elapsed time period being less than the predetermined time period.

42. The method of claim 33 wherein step of measuring a parameter of the multiple compressor system includes the step of measuring a temperature of the secondary liquid leaving the evaporator.

43. The method of claim 42 wherein the step of measuring a parameter of the multiple compressor system further includes the step of calculating a difference between the measured temperature of the secondary liquid leaving the evaporator and the setpoint temperature.

44. The method of claim 43 wherein the predetermined rate of change for the measured parameter is between about 0.5 degrees per minute and about 2 degrees per minute.

45. The method of claim 44 wherein the predetermined rate of change for the measured parameter is about 1 degree per minute.

46. The method of claim 33 wherein the step of measuring a parameter of the multiple compressor system includes the step of measuring a refrigerant temperature in the evaporator.

47. The method of claim 33 wherein the step of measuring a parameter of the multiple compressor system includes the step of measuring a refrigerant pressure in the evaporator.

* * * * *